US005862977A

United States Patent [19]

Hirano

[11] Patent Number: 5,862,977

[45] Date of Patent: Jan. 26, 1999

[54] FOOD CONTAINER AND TRAY

[75] Inventor: Kunihiro Hirano, Gifu-ken, Japan

[73] Assignee: Hirano Shiki Co., Ltd., Japan

[21] Appl. No.: 601,058

[22] PCT Filed: Jun. 7, 1995

[86] PCT No.: PCT/JP95/01120

§ 371 Date: Mar. 13, 1996

§ 102(e) Date: Mar. 13, 1996

[87] PCT Pub. No.: WO96/40562

PCT Pub. Date: Dec. 19, 1996

[51] Int. Cl.[6] ..... B65D 3/28

[52] U.S. Cl. ..... 229/5.82; 229/4.5; 229/5.5; 229/400

[58] Field of Search ..... 229/3.5 MF, 4.5, 229/5.5, 123, 186, 400, 406, 5.82

[56] References Cited

U.S. PATENT DOCUMENTS

| | | | |
|---|---|---|---|
| 1,310,698 | 7/1919 | Hill | 229/400 |
| 1,864,835 | 6/1932 | Lackner | 229/400 |
| 2,304,278 | 12/1942 | Poster | 229/400 |
| 2,493,086 | 1/1950 | Reifsnyder | 229/5.5 |
| 2,641,402 | 6/1953 | Bruun | 229/4.5 |
| 2,967,652 | 1/1961 | Canfield et al. | 229/3.5 MF |
| 3,833,113 | 9/1974 | Osier | 229/186 |
| 5,339,565 | 8/1994 | Weder et al. | 229/4.5 |

FOREIGN PATENT DOCUMENTS

| | | | |
|---|---|---|---|
| 1144102 | 10/1957 | France | 229/4.5 |
| 57-194439 | 12/1982 | Japan . | |
| 59-17769 | 5/1984 | Japan . | |
| 63-38415 | 2/1988 | Japan . | |
| 2-53302 | 11/1990 | Japan . | |
| 111246 | 5/1991 | Japan | 229/4.5 |
| 444725 | 3/1936 | United Kingdom | 229/4.5 |
| 689096 | 3/1953 | United Kingdom | 229/3.5 MF |
| 732228 | 6/1955 | United Kingdom | 229/3.5 MF |

*Primary Examiner*—Gary E. Elkins
*Attorney, Agent, or Firm*—Sheridan Ross P.C.

[57] ABSTRACT

A food carrier including a container body with an opening and a lid conforming to the opening of the container body is described. The container body is formed of a sheet of material and comprises a bottom and a peripheral wall that extends upward from the periphery of the bottom. A plurality of folds are provided at least part of the peripheral wall. At least part of the plurality of folds overlap one another. A support portion is formed by rolling part of the peripheral wall at the periphery of the opening. A lid is removably mounted on the support portion. A tray supports a number of containers.

24 Claims, 7 Drawing Sheets

FOOD CONTAINER AND TRAY

BACKGROUND OF THE INVENTION

1. Field of the Invention

The present invention relates to a container for housing food and a tray using the container.

2. Description of the Prior Art

Conventionally, containers having a variety of shapes, sizes and materials have been used to contain various foods such as rice, side dishes and the like. One container of this kind, for example, is a container for carrying rice or a side dish, such as a lunch box, which is sold at stands of railway stations for tourists. The container needs to be sufficiently rigid to carry food. Thus many conventional food containers are shaped from materials such as wood, styro-foam, cardboard, etc. Typically, such food containers are used with lids conforming to their openings.

A food container manufactured to have rigidness or strength as a top priority is not easily crushed into a compact piece for disposal, which results in bulky garbage. Such garbage needs a large disposal space compared to compact garbage, which is undesirable in view of obvious environmental concerns.

Food containers formed of a material thinner than cardboard may have an improved crushability. However, such containers are subject to spilling due to the easy deformation of the material. Further, it is troublesome to reliably mount a lid on an opening that tends to deform.

Accordingly, it is an object of the present invention to provide a food container that can be crushed into a compact piece for disposal and further, one that has enough rigidity for a lid to be reliably mounted thereon and is easy to handle.

SUMMARY OF THE INVENTION

To achieve the above object, the present invention comprises a combination of a container body with an opening and a lid corresponding to the configuration of the opening of the container body. The container body is formed of a sheet material and comprises a bottom and a surrounding wall which protrudes upward from the periphery of the bottom. A plurality of folds are formed at least in part of the peripheral wall, at least part of which overlap with one another. A support portion is formed by rolling part of the surrounding wall at the periphery of the opening. The lid is removably mounted on the support portion.

Accordingly, a container is given enough strength for a lid to be reliably mounted on the container body even though the container can be crushed into a compact piece at the time of disposal and thus it is easy to handle.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with accompanying drawings in which:

BEST MODE FOR CARRYING OUT THE INVENTION

Several embodiments of a food container and a tray according to the present invention will be described hereinafter with reference to FIGS. 1–4.

Figure 1:
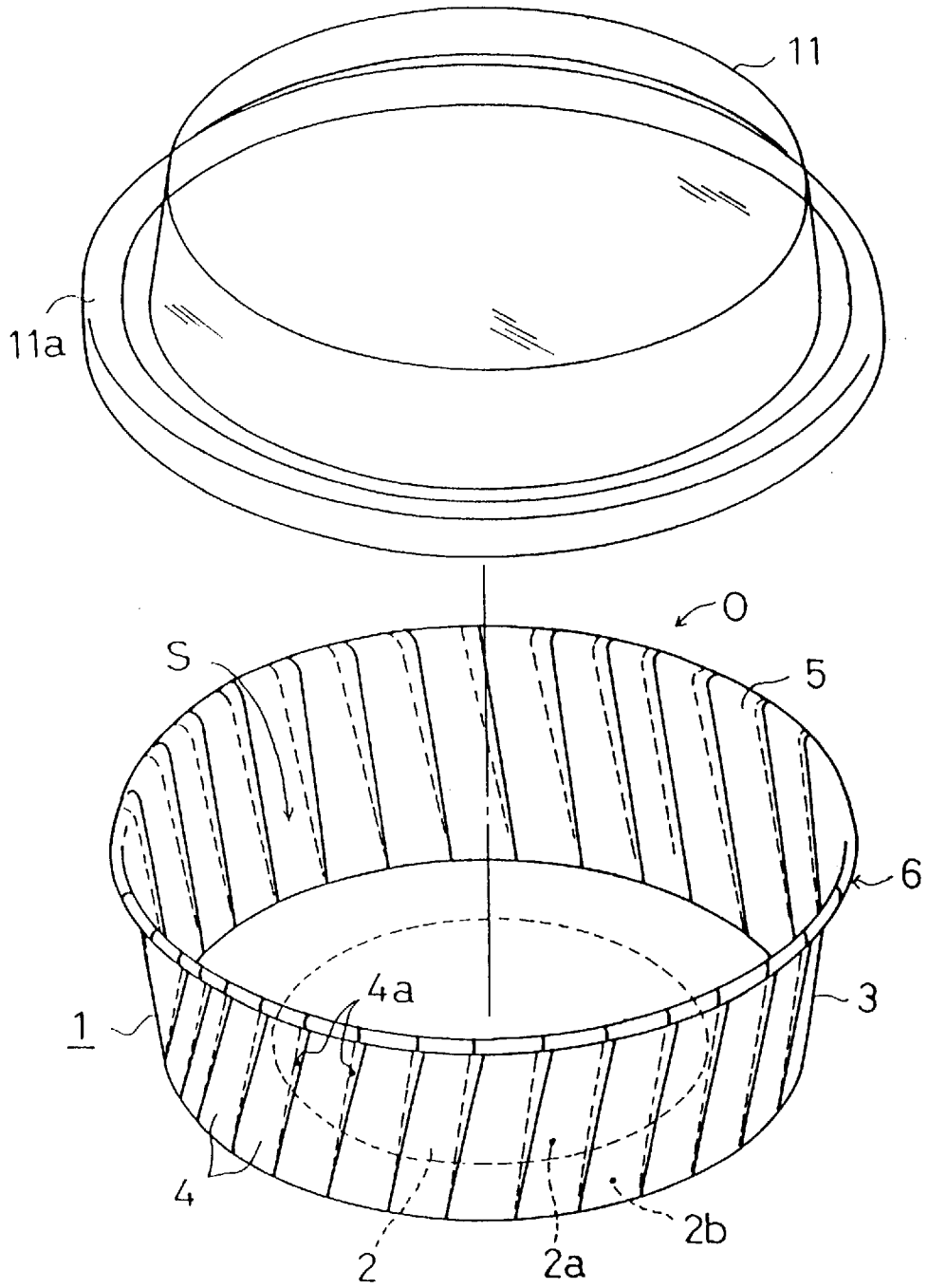
FIG. 1 is a perspective view showing a container body and a lid within the present invention.

FIG. 1 shows a container body 1 and a lid 11 comprising a part of a food carrier 14. The container body 1 in this embodiment is made of a sheet material M. The sheet material M is a single layer thinner than conventional wood block or cardboard. For example, a sheet of thin paper, nonwoven fabric or aluminum foil can be used as the material M. A laminated sheet may also be used. Such a laminated sheet is provided with a layer of synthetic resin R by thermocompression-bonding a synthetic resin such as polyethylene, polypropylene, vinylidene chloride, silicone resin, or the like to a surface, part of both surfaces or to both entire surfaces of this material. Further, the sheet material such as paper, nonwoven fabric, or the like may be impregnated with the above-mentioned synthetic resin.

In the preferred embodiment, a material M in which silicone resin is thermocompression-bonded to a surface of paper is used. A container body 1 with a predetermined shape is formed by drawing this material M in a die. In this case, the inner surface covered by the silicone resin provides the body 1 with waterproofing, oilproofing and thermal resistance.

As shown in FIG. 1, a container body 1 has a substantially cylindrical shape, a circular bottom 2 and a peripheral wall 3 extending upward from the periphery 2*b* of the bottom 2. A circular opening O is formed at the upper end 5 of the peripheral wall 3. The inner diameter of the opening O is slightly larger than the outer diameter of the bottom 2. A container space S is defined by the bottom 2 and the peripheral wall 3. A central portion 2*a* of the bottom 2 slightly protrudes toward the container space S with respect to the periphery 2*b*. However, the bottom 2 can be formed in a flat shape.

As shown in FIG. 1, a plurality of folds 4 are provided on the entire outer surface of the peripheral wall 3. The adjacent folds overlap one another. The overlapping portions 4*a* of the folds 4 are not thermocompression-bonded and thus are not bonded to one another.

Figure 2:
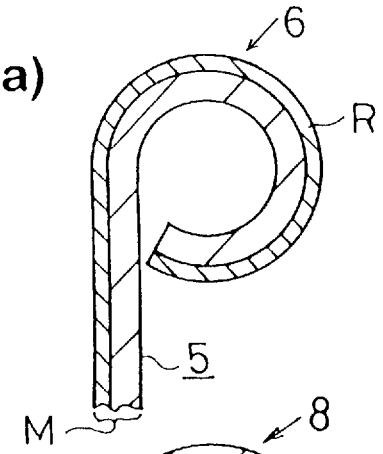
FIG. 2(*a*) is a partial enlarged cross-sectional view showing a rim portion of the container body, and FIGS. 2(*b*)–(*d*) are partially enlarged cross-sectional views respectively showing modified examples of the rim portion.
Figure 2:
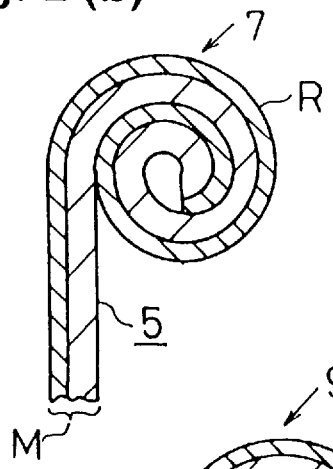
Figure 2:
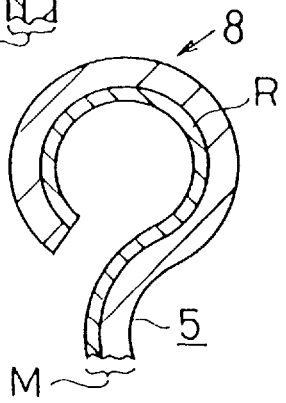
Figure 2:
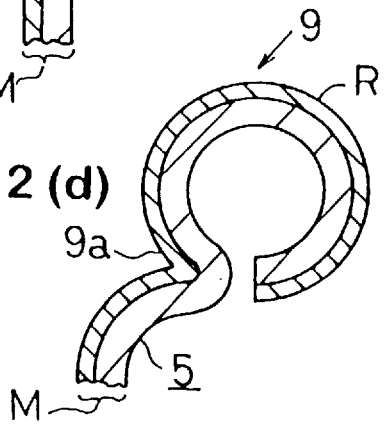

As shown in FIGS. 1 and 2(*a*), a curl-shaped support portion 6 is provided along the entire periphery of the opening O. The support portion 6 is formed by rolling the upper part of the peripheral wall 3 outward such that, it protrudes externally from the opening O. This support portion 6 can be formed at the same time that the container body 1 is formed. This support portion 6 reinforces the container body 1 and prevents the folds from separating.

Therefore, the configuration of the container body 1 is reliably maintained even where a thin material is used.

The shape of the support portion 6 is not limited to that shown in FIG. 2(*a*). For example, as shown in FIG. 2(*b*), a support portion 7 that is rolled a plurality of times may be provided. As shown in FIG. 2(*c*), a support portion 8 that is rolled inward from the container body 1 can also be provided. Furthermore, as a support potion 9 shown in FIG. 2(*d*), the physical strength of the upper end 5 of the peripheral wall 3 is intended to be increased by forming a bending part 9*a* throughout the entire periphery of the upper end 5 of the peripheral wall 3 in the initial part of the rolling.

Figure 3:
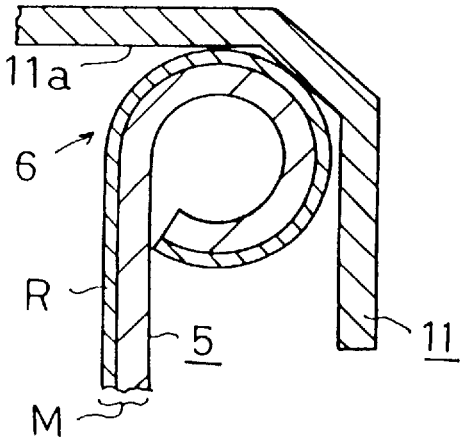
FIG. 3 is a partially enlarged cross-sectional view showing a lid mounted on the container rim.

In this embodiment, a lid 11 to be put on the container body 1 is used, which corresponds to the size and shape of the opening O. The lid 11 is formed of a transparent plastic material. When the lid 11 is put on the support portion 6 of the container body 1 from above, a flange 11*a* of the lid 11 is supported by the support portion 6 from below as shown in FIG. 3.

Figure 4:
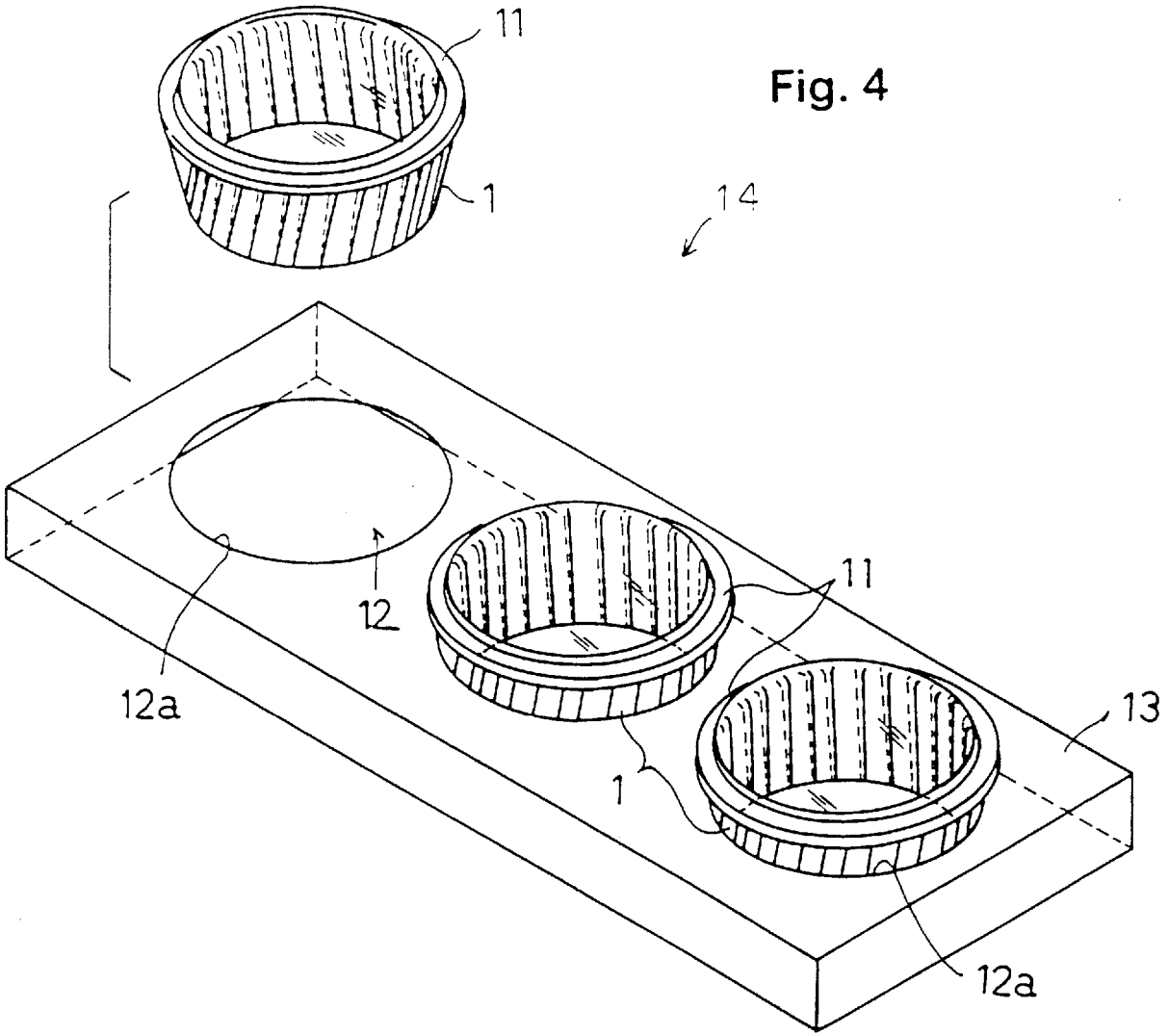
FIG. 4 is a perspective view showing a tray and cooperating containers.

FIG. 4 shows a food carrier 14 including the above-mentioned container bodies 1 and lids 11 and a tray 13. Container holes 12 for holding the container bodies 1 are formed on the upper surface of the box-shaped tray 13. In the preferred and illustrated embodiment, three holes, which are smaller than the outer diameter of the upper end portion of the peripheral wall 3 and the support portion 6, are formed as the container holes 12.

Thus, when the container body 1 is inserted into the container hole 12 from above, the peripheral wall 3 will engage the inner edge of an opening 12*a* of the container hole 12 as shown in FIG. 4 so that the container body 1 is reliably held onto the upper surface of the tray 13. The container body 1 does not fall off downward from the container hole 12 since the inner diameter of each container hole 12 is smaller than the outer diameter of the support portion 6. The tray 13 does not need to be as rigid as a conventional lunch box since the tray 13 primarily aims at holding the container body 1. Therefore, in this embodiment, the tray 13 is formed with a sheet of paper thinner than a wood block or cardboard.

The food carrier 14, as constructed above, is easy to carry when food such as rice, a side dish, or the like is housed in the container body 1 and the container body 1 is mounted on the tray 13. The opening O, which is most likely to deform in the container body 1, is reinforced by the support portion 6 formed at the upper end of the peripheral wall 3. As a result, strength is given to the container body 1 and the entire configuration of the container body 1 is reliably maintained. Even if the container body 1 or opening O is temporarily deformed by external forces, it is possible to restore it to the original shape. Therefore, spilling of the contents is reliably avoided even if the opening O is deformed when the support portion 6 is held to take the container body 1 out of the tray 13. Thus the food can be eaten, for example, when one of the container bodies 1 is held by a hand as well as when the container bodies 1 are held in the tray 13. Moreover, if the container body 1, the lid 11 and the tray 13 are formed of a highly heat-resistant material, they, along with the food, can be heated by a microwave oven or other type of oven.

When food that has a different cross-section from the opening O and has dimension that is the substantially same size as the inner diameter of the opening O is placed in the container body 1, the food will be pushed into a container space S. Then the opening O will be deformed and allow the food to pass through it. After food is housed, the food will be reliably held in the container space by the restoring force of the support portion 6. Therefore, when such food is housed, there is no necessity for deforming the opening O correspondingly to the shape of the food in advance. This can result in automated and high-speed packing of food.

Since the support portion 6 protruding outward is provided at the opening O, it is also easy to take the container body 1 out of the container hole 12 of the tray 13 by grasping the support portion 6. A plurality of container bodies 1 can also be stacked when the lids 11 are put on the container bodies 1.

In addition, with the container body 1 as constructed above, the lid 11 can be put onto the opening O, the configuration of which is held by the support portion 6, so that the fitting of the lid is easily and reliably conducted. This leads to easy handling. Thus a food carrier having a variety of foods can be made by packing different kinds of foods in a plurality of container bodies 1, subsequently putting the lids 11 on, and properly selecting and housing them in the tray 1.

In this embodiment, the contents of the container body can be seen externally even if the lid 11 is on since the lid 11 is made of transparent plastic. This is desirable for both the purchaser and the food preparer.

Both the container body 1 and the tray 13 can be easily crushed into a compact piece during disposal since they are formed of thin materials. Therefore, the bulkiness of the resulting garbage can be reduced as compared with prior art container that are made of wood or styro-foam. Even children or the aged can easily crush a tray 14 into a compact piece.

In addition, the support portion 6, which is provided at the opening O, prevents the folds 4 from extending outward in advance. Thus there is no necessity for bonding the adjacent folds 4 to one another by means of heat sealing. This enables the container body to be easily and inexpensively manufactured. Additionally, the support portion 6 improves the decoration and design of the container body 1. The folds 4 of the peripheral wall 3 also improve the decoration and design of the container body 1. Various patterns or characters can be printed on the surface of the material such that they appear on the outer surface of the container body 1. The container body 1 can be manufactured with a material without a layer of synthetic resin R. In this case, the manufacturing cost is reduced.

Further, when the container body is manufactured solely by a sheet of paper, it is advantageous to use it as a container of poundcake. The paper container absorbs oil from the poundcake to some degree. Thus, the poundcake has a favorable taste and its fattiness is reduced.

Figure 9:
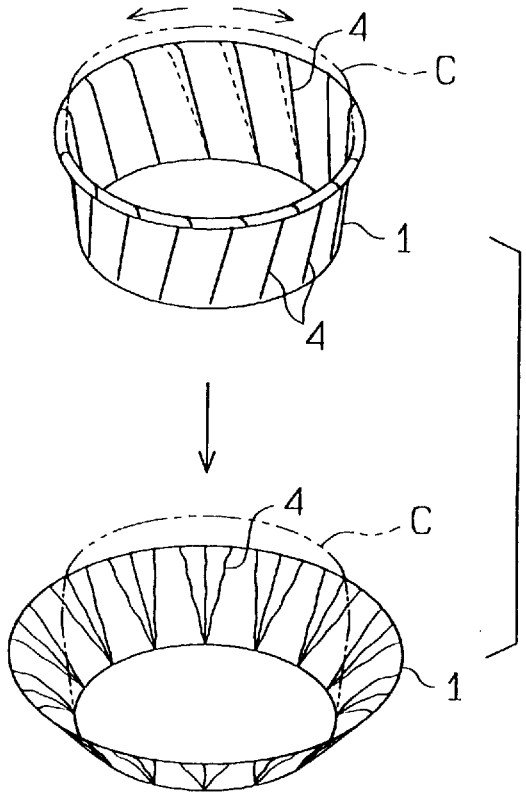
FIG. 9 is a perspective view showing a process in which a food item is separated from the container body.

When cake is served in the container 1, the support portion 6 is held with fingers of both hands and then the folds 4 are spread out along the periphery of the support portion 6 in order to take a cake C out of the container body 1 as shown in FIG. 9. When this manipulation is conducted with all of the folds 4, the peripheral wall 3 of the container body 1 can be easily detached from the outer periphery of the cake C. Creases are left after the folds 4 are spread out. The cake C, however, can be easily eaten by using the container body 1 like a dish.

In this embodiment, the container body 1 does not need tearing off when the cake C is removed since the folds 4 are not bonded to one another. Thus there is no necessity for forming perforations or the like for easily tearing the container body off. Therefore, the container body can be manufactured inexpensively compared with a container body with perforations.

Figure 5:
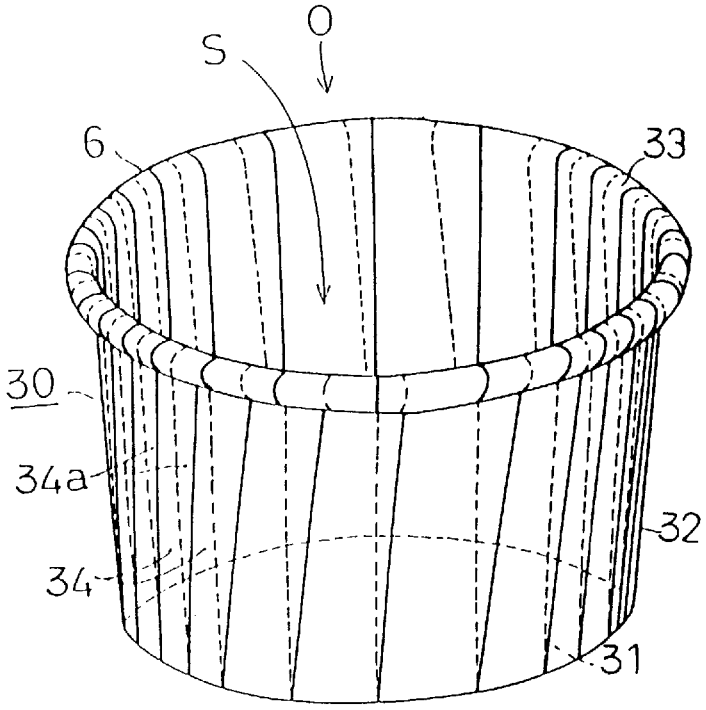
FIG. 5 is a perspective view showing a modification of the container body.

FIG. 5 shows a second embodiment of the invention. The container body 30 of the second embodiment has an elliptic bottom 31. The upper end 33 of the peripheral wall 32 takes an elliptic shape with a slightly larger diameter than that of the bottom 31. A plurality of folds 34 are formed in the entire outer surface of the peripheral wall 32. Overlapping portions 34*a* of the adjacent folds 34 are not bonded to one another in the same manner as the previously described embodiment. A support portion 6 as shown in FIG. 2(*a*) is provided at the upper end 33 of the peripheral wall 32.

Figure 6:
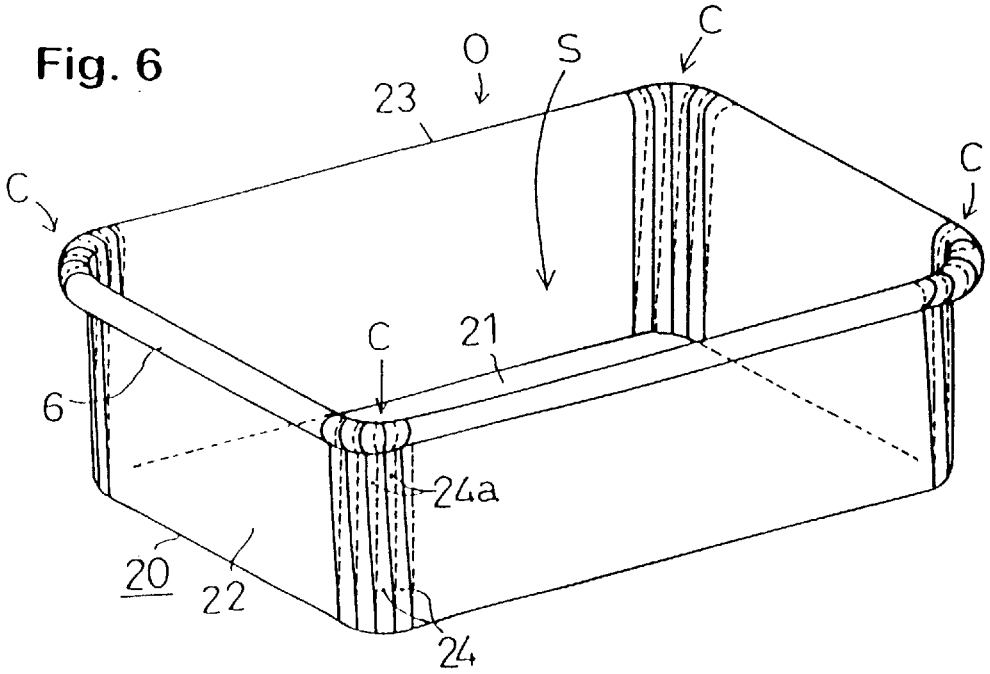
FIG. 6 is a perspective view showing an additional modification of the container body.

FIG. 6 shows a third embodiment of the invention. A container 20 of the third embodiment has a rectangular bottom 21 and a peripheral wall 22 extending upward therefrom. The peripheral wall 22 is bent on each corner C wherein a plurality of folds 24 are formed. Overlapping portions 24*a* of the adjacent folds 24 are not bonded to one another in the same manner as the previously mentioned embodiment. A support portion 6 as shown in FIG. 2(*a*) is provided at the entire upper end 23 of the peripheral wall 22. Therefore, in each example mentioned above, the same operations and effects of the embodiment are achieved.

Figure 7A:
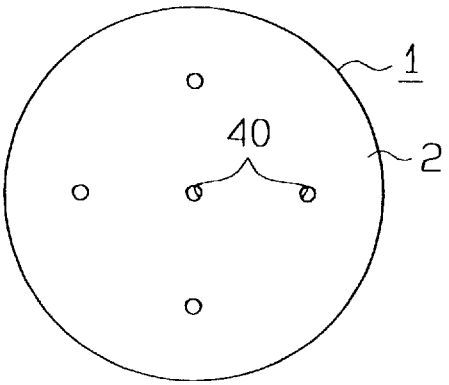
FIGS. 7(*a*), (*b*) and (*c*) are bottom plan views respectively showing variations of the bottom of the container body.
Figure 7B:
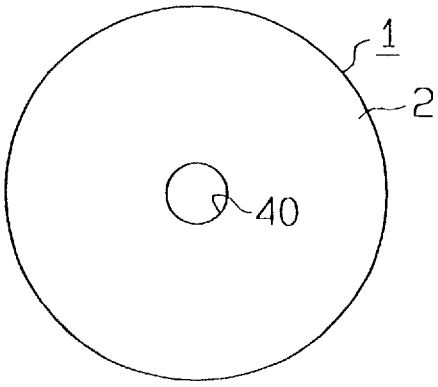
Figure 7C:
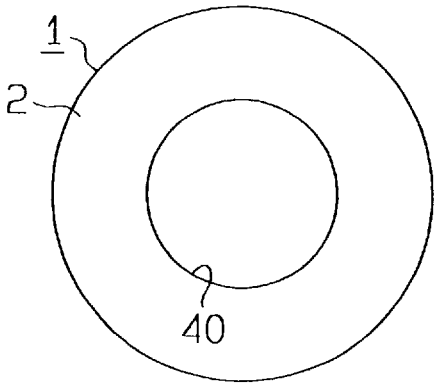

Further, the container body 1 of the invention can also be used to contain cake batter made from flour and sugar to which oils and fats are added. In this case, the cake batter is put in the container body 1 to be heated by a heating board. Then the oils and fats scatter and the cake batter expands along the peripheral wall of the container body. Preferably, the bottom 2 of the container body 1 has a through hole(s) 40 as shown in FIGS. 7(*a*)–(*c*) in order to improve the passing of heat through the cake batter and to brown the cake. The number, shape, size and arrangement of the through holes 40 are not particularly limited. The container shown in FIG. 7(*a*), for example, has five circular through holes 40. The inner diameter of the bottom 2 is approximately 100 mm. The inner diameter of each hole 40 is approximately 4 mm. In the containers shown in FIGS. 7(*b*) and (*c*), a circular through hole 40 is formed at the center of the bottom 2. In the examples of FIGS. 7(*b*) and (*c*), the inner diameters of the bottoms 2 are approximately 100 mm; however, the inner diameters of the circular through holes 40 are approximately 15 mm and approximately 50 mm, respectively.

The present invention is not restricted to the embodiments mentioned above and can be modified as follows. The bottom 2 and the opening O may be differently configured; for example, the bottom 2 may be circular and the opening O may be square.

Even when the container body 1 is substantially cylindrical, the folds may be formed on part of rather than the entire outer surface of the peripheral wall.

Figure 8:
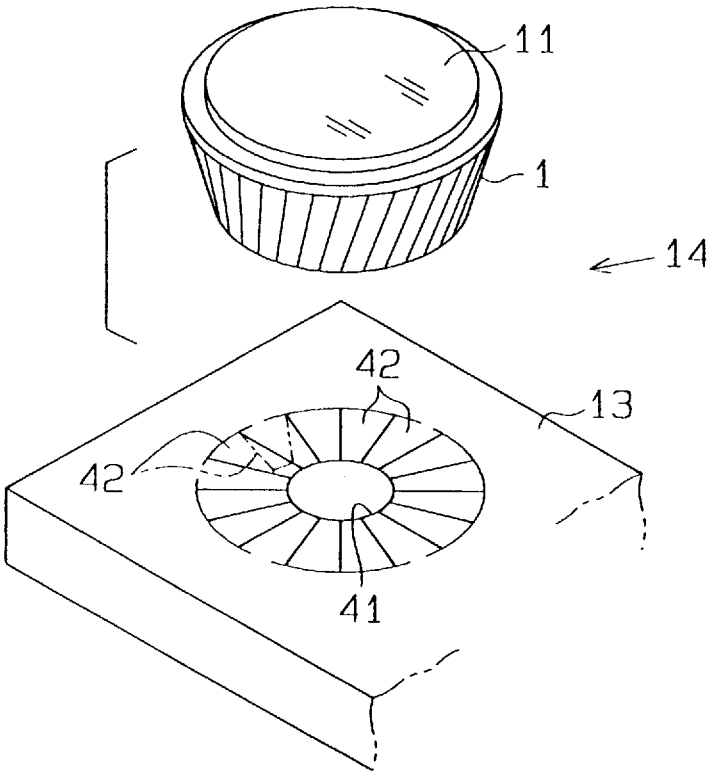
FIG. 8 is a partial perspective view showing a modification of the tray.
Figure 10:
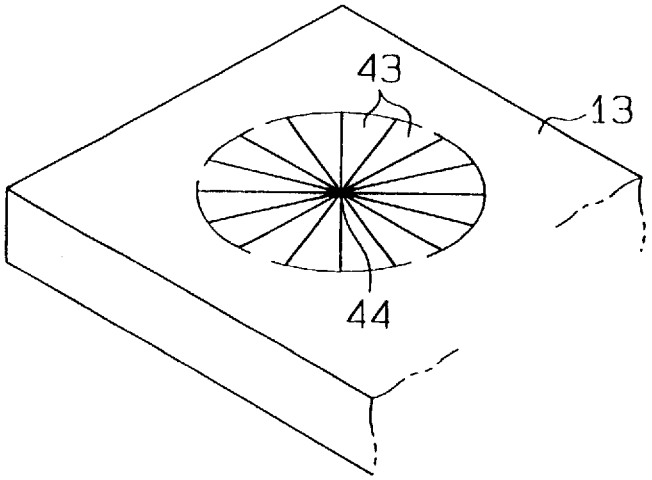
FIG. 10 is a partial perspective view showing another embodiment of the tray.

The number of container holes 12 of the tray 13 is not restricted to three. A plurality of container holes with different sizes and shapes may be provided on the upper surface of one tray 13 to contain a various kinds of container bodies with different shapes. Further, as shown in FIG. 8, a hole 41 with a smaller diameter than that of the container hole 12 may be provided on the tray 13 in place of the container holes 12 shown in FIG. 4. a plurality of movable segments 42 may be formed that extend radially from the hole 41 by forming a plurality of radial slits. In this case, each segment 42 is bent downward as shown by a two-dot chain line in FIG. 8 by pressing the bottom of the container body 1 against the segments 42 from above. Then the hole 41 becomes larger, and the container body 1 can be housed therein. The segments 42 bent are pressed against the external peripheral wall of the container body 1 so that the container body can be held in a more stable manner. The number of holes 41 and their diameters and the number of segments 42 can be properly determined as occasion demands. As shown in FIG. 10, the hole 41 may be omitted. In this case, a plurality of segments 43 may be made by forming a plurality of movable segments which extend radially from a point 44 on the tray 13. In this case, the operation is the same as in the above-mentioned case. Namely, each segment 43 is bent downward by pressing the bottom of the container body 1 against each slice 43 from above. Then a hole is formed for housing the containing body, and the container body 1 can be placed therein.

The contents to be housed in the container body 1 are not limited to solid foods. For example, liquid food and solid foods that contain much water may be contained.

The container body 1 in the embodiment is used in combination with the tray 13 as a component of the food container 14. In addition, the container body 1 may independently be used for containing and carrying food.

The lid 11 does not necessarily need to be transparent and plastic. For example, the lid 11 can also be formed with a sheet of thin paper etc. in the same manner as the container body 1.

As described in detail above, a container of the present invention has enough strength to reliably support a lid, and, it can be crushed into a compact size at the time of disposal. Accordingly, its manipulation is easy. Further, the food carrier according to the present invention reduces the bulkiness of the resulting garbage since it is provided with a container body that is made of a thin material.

I claim:

1. A container having a container body, said container body including an opening and a lid for covering the opening, said container comprising:

said container body being made of a sheet material including a synthetic resin and having a planar configuration capable of being conformed to include (a) through (c):

(a) a substantially planar bottom and a peripheral wall extending upward from a periphery of the bottom;

(b) a plurality of folds formed at least on a part of the peripheral wall, at least a part of said folds overlapping one another, wherein each of said folds is capable of being unfolded so that said container reassumes the planar configuration;

(c) a support portion formed by rolling a part of the peripheral wall, said support portion being arranged adjacent the opening;

wherein said support portion and each of said folds are capable of being manually deformed so that said container reassumes the planar configuration.

2. The container as set forth in claim 1, where said sheet material has a layer formed by one selected from the group consisting of a sheet of paper, non-woven fabric and metal foil.

3. The container as set forth in claim 2, wherein said synthetic resin includes one selected from the group consisting of polyethylene, polypropylene, vinylidene chloride and silicone resin.

4. The container as set forth in claim 3, wherein said sheet material is made of the paper having a layer of the silicone resin thermocompression-bonded to a surface of the paper, and wherein said surface covered by the layer of the silicone layer is provided on inner surface of the container body.

5. The container as set forth in claim 4, wherein said container body is processed by pressing the sheet material.

6. The container as set forth in claim 5, wherein said support portion extends outwardly, and wherein the lid has a flange engaging the support portion from above.

7. The container as set forth in claim 1, wherein said lid has a flange for overlapping engagement with said support portion, wherein when in engagement with said support portion, said flange has a flange wall substantially parallel with said peripheral wall, said flange wall extending beyond an extent of said support portion in a direction toward said bottom.

8. The container as set forth in claim 1, wherein said bottom includes one or more holes therein.

9. A container having a container body, said container body including an opening and a lid in conformity with the opening, said container comprising:

said container body being made of a sheet material;

said sheet material having a single layer formed by the one selected from the group consisting of a sheet of paper, non-woven fabric and metal foil;

said container body including a bottom and a peripheral wall extending upward from a periphery of the bottom;

a plurality of folds provided at least on a part of the peripheral wall, at least a part of said folds overlapping one another;

a support portion formed by rolling a part of the peripheral wall, said support portion being arranged to detachably receive the lid;

each of said folds being arranged to be spread out along the support portion so as to be flatly deformed;

said lid having a flange for overlapping engagement with said support portion, wherein when in engagement with said support portion, said flange has a flange wall substantially parallel to said peripheral wall, said flange wall extending beyond an extent of said support portion in a direction toward said bottom.

10. The container as set forth in claim 9, wherein said sheet material is made of the one selected from the group consisting of polyethylene, polypropylene, vinylidene chloride and silicone resin.

11. The container as set forth in claim 9, wherein said sheet material is made of the paper having a layer of the silicone resin thermocompression-bonded to a surface of the paper, and wherein said surface covered by the layer of the silicone layer is provided on inner surface of the container body.

12. The container as set in claim 11, wherein said container body is processed by pressing the sheet material.

13. The container as set forth in claim 12, wherein said support portion extends outwardly, and wherein the lid has a flange engaging the support portion from above.

14. The container as set forth in claim 9, said container further including a tray which has container portions each of which holds the container body.

15. The container as set forth in claim 14 having the container, wherein each of said container portions includes a hole in an inner extent of which is smaller than an outer extent of the support portion.

16. The container as set forth in claim 15, wherein each of said container portions includes a plurality of segments extending radially, and wherein each of said segments is bent downward in the tray by pressing the bottom of the container body against the segment so as to engage the peripheral wall of the container body.

17. A lunch box having a container comprising:

said container having a container body, said container body including an opening and a lid in conformity with the opening, said container comprising:

said container body being made of a sheet material;

said container body including a bottom and a peripheral wall extending upward from a periphery of the bottom;

plurality of folds provided at least on a part of the peripheral wall, at least a part of said folds overlapping one another;

a support portion formed by rolling a part of the peripheral wall, said support portion being arranged to detachably receive the lid;

each of said folds being arranged to be spread out along the support portion so as to be flatly deformed; and a tray having a plurality of openings, wherein each opening is capable of receiving said container and retaining said container in the opening.

18. The lunch box as set forth in claim 17, wherein said sheet material having a single layer formed by the one selected from the group consisting of a sheet of paper, nonwoven fabric and metal foil.

19. The lunch box as set forth in claim 18, wherein said sheet material is made of the one selected from the group consisting of polyethylene, polypropylene, vinylidene chloride and silicone resin.

20. The lunch box as set forth in claim 19, wherein said sheet material is made of paper having a layer of the silicone resin thermocompression-bonded to a surface of the paper, and wherein said surface covered by the layer of the silicone layer is provided on inner surface of the container body.

21. The lunch box as set forth in claim 20, wherein said container body is processed by pressing the sheet material.

22. The lunch box as set forth in claim 21, wherein said support portion extends outwardly, and wherein the lid has a flange engaging the support portion.

23. The lunch box as set forth in claim 22, wherein said flange, when engaging the support portion, has a flange wall substantially parallel to said peripheral wall, said flange wall extending beyond an extent of said support portion in a direction toward said bottom.

24. The lunch box as set forth in claim 21, wherein said support portion extends outwardly, and wherein the lid has a flange engaging the support portion.

* * * * *